US008790153B2

(12) United States Patent
Campbell

(10) Patent No.: US 8,790,153 B2
(45) **Date of Patent: *Jul. 29, 2014**

(54) ADJUSTABLE BREAST SUPPORT GARMENT

(71) Applicant: Sheila K. Campbell, Minturn, CO (US)

(72) Inventor: Sheila K. Campbell, Minturn, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/030,828

(22) Filed: Sep. 18, 2013

(65) Prior Publication Data

US 2014/0017978 A1 Jan. 16, 2014

Related U.S. Application Data

(63) Continuation of application No. 13/093,095, filed on Apr. 25, 2011, now Pat. No. 8,545,287, which is a continuation-in-part of application No. 12/792,941, filed on Jun. 3, 2010, now Pat. No. 8,500,513.

(60) Provisional application No. 61/185,672, filed on Jun. 10, 2009.

(51) Int. Cl.
*A41C 3/00* (2006.01)

(52) U.S. Cl.
USPC ..... 450/60; 450/63; 450/66; 450/67

(58) Field of Classification Search
CPC ..... A41C 3/0028; A41C 3/0021
USPC ..... 450/30–33, 60–67, 86
See application file for complete search history.

(56) References Cited

U.S. PATENT DOCUMENTS

| | | | | |
|---|---|---|---|---|
| 1,584,525 | A * | 5/1926 | Freeman | 450/62 |
| 1,590,693 | A * | 6/1926 | McKeefrey | 450/61 |
| 2,175,676 | A * | 10/1939 | Walters | 450/63 |
| 2,421,448 | A * | 6/1947 | Witkower | 450/63 |
| 2,621,328 | A * | 12/1952 | Duchnofskey | 450/53 |
| 2,700,160 | A * | 1/1955 | Scholfield | 450/31 |
| 2,734,193 | A * | 2/1956 | Croxall | 450/63 |
| 3,200,821 | A | 8/1965 | Anderson | |
| 3,459,190 | A | 8/1969 | Frischer et al. | |
| 4,144,912 | A | 3/1979 | Pundyk | |
| 4,372,320 | A * | 2/1983 | Silber | 450/31 |
| 4,413,626 | A | 11/1983 | Capasso | |
| 4,781,651 | A | 11/1988 | Ekins | |

(Continued)

FOREIGN PATENT DOCUMENTS

| | | |
|---|---|---|
| EP | 0928568 | 7/1999 |
| JP | 2005281920 | 10/2005 |
| WO | WO2005-067743 | 7/2005 |

OTHER PUBLICATIONS

International Search Report and Written Opinion dated Feb. 1, 2011 for International Patent Application No. PCT/US2010/037157.

(Continued)

*Primary Examiner* — Gloria Hale

(74) *Attorney, Agent, or Firm* — Snell & Wilmer L.L.P.

(57) ABSTRACT

A breast support garment is configured with adjustable straps, cups, and/or other components in order to facilitate modification of the appearance of the bust. Modifying the length of certain straps causes the cups to move upwards/downwards and/or inwards/outwards with respect to the center of the breast support garment. Shoulder straps or other portions of the breast support garment may pass through guide loops and/or couple to the breast cups or garment shell to permit adjustment. The location of each breast cup may be independently adjusted.

9 Claims, 17 Drawing Sheets

(56) References Cited

U.S. PATENT DOCUMENTS

| | | | | |
|---|---|---|---|---|
| 4,956,878 | A * | 9/1990 | Boynton | 2/67 |
| 5,024,628 | A | 6/1991 | Sanchez | |
| 5,152,741 | A | 10/1992 | Farnio | |
| 5,221,227 | A | 6/1993 | Michels | |
| 5,538,502 | A | 7/1996 | Johnstone | |
| 5,749,768 | A | 5/1998 | Green | |
| 5,951,364 | A | 9/1999 | Brown et al. | |
| 5,971,834 | A | 10/1999 | Murray | |
| 6,142,852 | A * | 11/2000 | Lerolle-Lelorrain et al. | 450/65 |
| 6,165,045 | A | 12/2000 | Miller et al. | |
| 6,165,047 | A * | 12/2000 | Scott et al. | 450/55 |
| 6,168,498 | B1 | 1/2001 | Wagner | |
| 6,994,606 | B2 | 2/2006 | Li | |
| 7,232,359 | B1 | 6/2007 | Richardson | |
| 7,267,599 | B2 | 9/2007 | Allen et al. | |
| 7,427,226 | B1 | 9/2008 | Deal | |
| 7,448,937 | B2 | 11/2008 | Weyenberg et al. | |
| 7,452,260 | B2 | 11/2008 | Redenius | |
| 7,607,966 | B1 | 10/2009 | Fox | |
| 7,931,521 | B1 | 4/2011 | Griffin | |
| 8,469,769 | B2 * | 6/2013 | Hendrickson | 450/30 |
| 2003/0082994 | A1 | 5/2003 | Mitchell et al. | |
| 2011/0177756 | A1 * | 7/2011 | Morgan et al. | 450/60 |

OTHER PUBLICATIONS

International Preliminary Report on Patentability dated Dec. 22, 2011 in Application No. PCT/US2010/037157.

Notice of Allowance dated Jan. 6, 2011 in U.S. Appl. No. 12/122,144.

Office Action dated Sep. 23, 2010 in U.S. Appl. No. 12/122,144.

Office Action dated Oct. 4, 2012 in U.S. Appl. No. 12/792,941.

Final Office Action dated Feb. 20, 2013 in U.S. Appl. No. 12/792,941.

Notice of Allowance dated Apr. 30, 2013 in U.S. Appl. No. 12/792,941.

Notice of Allowance dated Jul. 24, 2013 in U.S. Appl. No. 13/093,095.

Office Action dated Feb. 20, 2013 in U.S. Appl. No. 13/093,095.

* cited by examiner

ADJUSTABLE BREAST SUPPORT GARMENT

CROSS REFERENCE TO RELATED APPLICATIONS

This application is a continuation of U.S. Ser. No. 13/093,095 filed on Apr. 25, 2011, now published as U.S. Patent Application Publication No. 2011/0201252 entitled "ADJUSTABLE BREAST SUPPORT GARMENT", U.S. Ser. No. 13/093,095 is a continuation-in-part of U.S. Ser. No. 12/792,941 filed on Jun. 3, 2010, now U.S. Pat. No. 8,500,513 entitled "ADJUSTABLE BREAST SUPPORT GARMENT", U.S. Ser. No. 12/792,941 is a non-provisional of U.S. Provisional No. 61/185,672 filed on Jun. 10, 2009 and entitled "BREAST SUPPORT GARMENT HAVING ADJUSTABLE CUPS." The entire contents of each of the foregoing applications are hereby incorporated by reference.

TECHNICAL FIELD

This disclosure generally relates to breast support garments, and more particularly, to brassieres and other garments having adjustable breast cups and/or other configurable portions.

BACKGROUND

Camisoles, tube tops, brassieres (otherwise known as bras) and the like have become popular breast support garments. However, there are several disadvantages associated with conventional breast support garments. For example, the breast cups are typically fixed in a single position, and therefore the cups only provide one level of support, shaping, and degree of comfort to the wearer. However, a wearer may desire a garment to provide varying fits and degrees of support, depending upon such factors as her choice of outer garments and/or level of physical exertion. For example, in certain situations, a wearer may desire to decrease the prominence of the bust, and therefore may prefer a minimal amount of upward support and the breast cups to be outwardly separated. In other situations, a wearer may prefer to have the appearance of a fuller bosom, and may therefore desire a maximum amount of upward support and the breast cups to be drawn together.

As such, it is desirable to provide an adjustable breast support garment, for example, a garment that permits a wearer to customize the location of the breast cups to match body type, desired level of support, choice of outer garments, and/or the like.

SUMMARY

This disclosure relates to breast support garments. In an exemplary embodiment, a breast support garment comprises a breast cup coupled to a shell, and a shelf portion coupled to the breast cup. The shelf portion is configured to push up a breast of a wearer of the breast support garment.

The contents of this summary section are provided only as a simplified introduction to the disclosure, and are not intended to be used to limit the scope of the appended claims.

BRIEF DESCRIPTION OF THE DRAWINGS

With reference to the following description, appended claims, and accompanying drawings:

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims. For example, the steps recited in any of the method or process descriptions may be executed in any order and are not necessarily limited to the order presented. Moreover, many of the functions or steps may be outsourced to or performed by one or more third parties. Furthermore, any reference to singular includes plural embodiments, and any reference to more than one component or step may include a singular embodiment or step.

For the sake of brevity, conventional techniques for garment design, construction, adjustment, modification, breast support, and/or the like, may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical breast support garment.

Figure 1A:
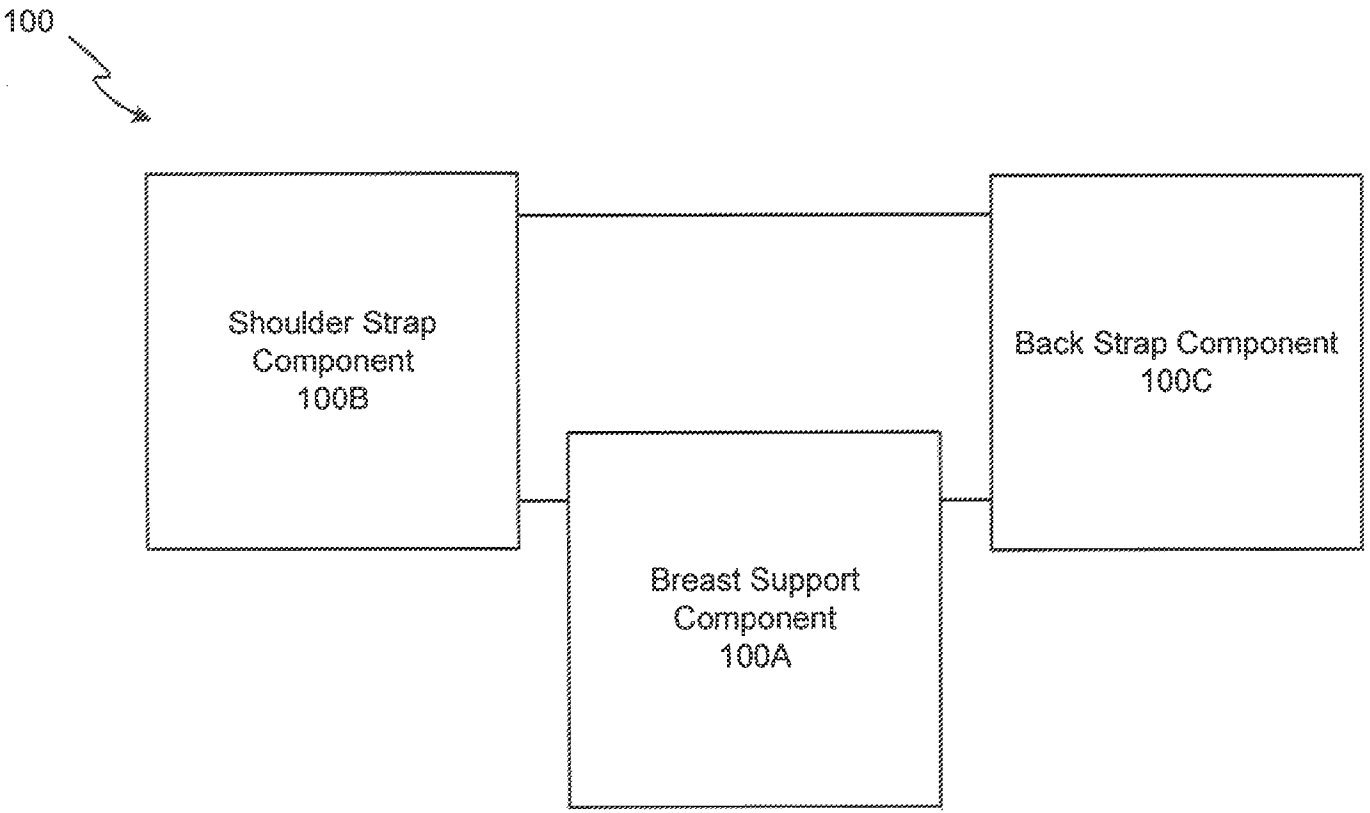
FIG. 1A illustrates a block diagram of a breast support garment in accordance with an exemplary embodiment.

A breast support garment may be any garment configured to releasably support a breast. In accordance with an exemplary embodiment, and with reference to FIG. 1A, a breast support garment 100 generally comprises a breast support component 100A, a shoulder strap component 100B, and a back strap component 100C. Breast support component 100A is configured to provide support to at least one breast. Breast support component 100A may comprise cups, tubes, straps, linkages, stitching, fabric, mesh, lace, fasteners, joints, and/or any other suitable materials and/or components configured to provide support to a breast. The support may be fixed. The support may also be adjustable and/or variable.

Shoulder strap component 100B is coupled to breast support component 100A. Shoulder strap component 100B may comprise, for example, straps, ribbon, joints, hooks, fasteners, sleeves, fabric, and/or the like, and/or any other suitable materials and/or components configured to releasably couple breast support component 100A to a wearer, for example by passing over the wearer's shoulders.

Back strap component 100C is coupled to breast support component 100A and/or shoulder strap component 100B. Back strap component 100C may comprise straps, ribbon, joints, hooks, fasteners, sleeves, fabric, and/or the like, and/or any other suitable materials and/or components configured to releasably couple breast support component 100A to a wearer, for example by linking opposing sides of breast support component 100A across the wearer's back.

In various exemplary embodiments, breast support garment 100 is configured to be adjusted while preventing the rear portion (e.g., back strap component 100C) from rising/riding up. Breast support garment 100 may comprise any suitable garment, for example a camisole, tube top, swimsuit, brassiere, lingerie, or other garment or apparel.

Figure 1B:
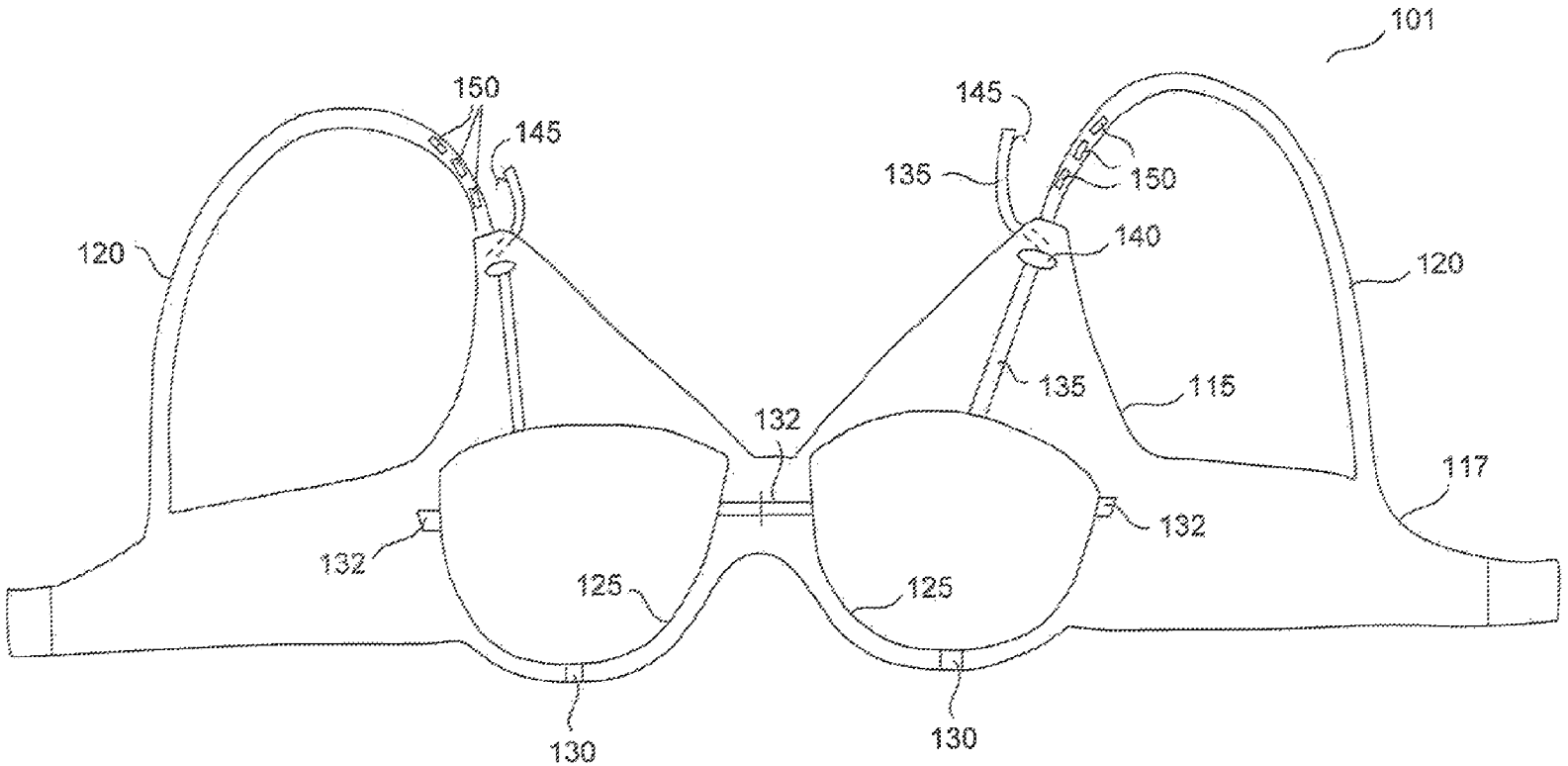
FIG. 1B illustrates a rear view of a brassiere having adjustable-length shoulder straps in accordance with an exemplary embodiment.

Turning now to FIG. 1B and in accordance with an exemplary embodiment, a breast support garment 100 (for example, brassiere 101) comprises shell 115 having band 117, shoulder straps 120, and cups 125. Elastic fasteners 130 and 132 connect cups 125 to shell 115. In various exemplary embodiments, the elasticity of fasteners 130 and 132 permit the location of cup 125 to be adjusted relative to shell 115. In various exemplary embodiments, fewer and/or more fasteners may be utilized to couple cups 123 and shell 115.

Shell 115 may comprise any suitable material, fabric, and/or the like, as desired. In an exemplary embodiment, shell 115 comprises cotton. In another exemplary embodiment, shell 115 comprises polyester. Moreover, shell 115 may comprise any suitable material for use in a breast support garment.

Fasteners 130, 132 may comprise any components configured to provide connectivity between shell 115 and cups 125. For example, fasteners 130, 132 may comprise a clasp, hook and loop fastener, snap, strap, band of elastic material, and/or the like. Moreover, one or more of fasteners 130, 132 may be elastic to permit (or inelastic to restrict) movement of cups 125 in various directions. For example, in an exemplary embodiment, fasteners 130 are substantially elastic and fasteners 132 are substantially inelastic. In this manner, each cup 125 is permitted to move vertically, but remains substantially fixed in the horizontal direction. Conversely, in another exemplary embodiment, fasteners 132 are substantially elastic and fasteners 130 are substantially inelastic to permit cups 125 to move horizontally, but restrict vertical movement.

Any number of fasteners 130, 132 may be used to attach cup 125 to shell 115. Additionally, cup 125 may be coupled to shell 115 any suitable location and/or locations. Moreover, cups 125 may be directly attached to shell 115 via any suitable method, such as by sewing or gluing.

Brassiere 101 may be configured to facilitate vertical movement of the breast cups relative to the shell. In an exemplary embodiment, brassiere 101 comprises adjustable length shoulder straps 120 coupled to breast cups 125. When the length of shoulder straps 120 is shortened, breast cups 125 move upwards relative to shell 115. Likewise, when the length of shoulder straps 120 is increased, cups 125 move downwards relative to shell 115. In this manner, the degree of "lift" imparted by brassiere 101 may be varied.

In an exemplary embodiment, with continued reference to FIG. 1B, cups 125 may be separate from shell 115 of brassiere 101. Stated another way, cups 125 may comprise separate material and/or be physically disconnected from shell 115. Brassiere 101 may also comprise one or more under-wires. However, in other exemplary embodiments, the under-wires may be removed. Moreover, brassiere 101 and portions thereof (e.g., cups 125, shell 115, etc) may comprise any suitable material (whether slip or non-slip), such as cotton, elastane, nylon, and/or the like.

In various exemplary embodiments, cups 125 are coupled to straps 135 in the interior of brassiere 101. Straps 135 extend through openings 140 in shell 115 and comprise fastening components 145 (depicted in FIG. 1B as a hook). Fastening components 145 may comprise any material, device, structure, and/or component capable of providing connectivity between shoulder strap 120 and cups 125. Suitable fastening components 145 include clasps, hook and loop fasteners, buttons, snaps, and/or the like. Fastening components 145 may be configured to removably attach along the length of shoulder straps 120 at one more attachment locations 150. Attachment of fastening components 145 at a higher attachment location 150 can cause fasteners 130 and/or 132 to stretch, and thus cups 125 adjust upward relative to shell 115. Conversely, attachment of fastening components 145 at a lower attachment location 150 can cause fasteners 130 and/or 132 to relax, and thus cups 125 adjust downward relative to shell 115.

Figure 2:
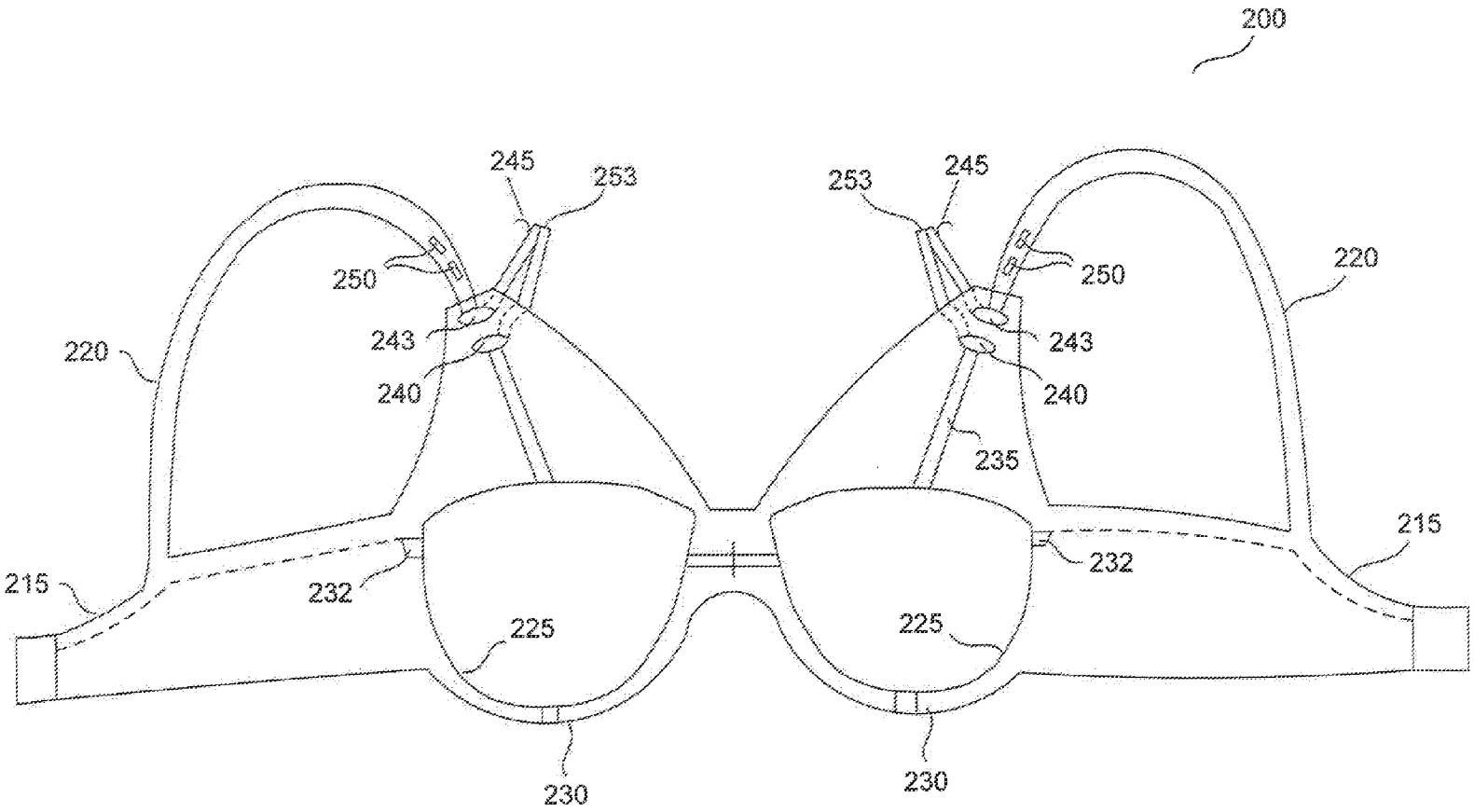
FIG. 2 illustrates a rear view of a brassiere having adjustable-length shoulder straps in accordance with an exemplary embodiment.

Turning now to FIG. 2, in an exemplary embodiment a camisole 200 is configured with shoulder straps coupled to breast cups to permit vertical movement of the breast cups. Cups 225 are connected to straps 235 in the interior of shell 215. Elastic fasteners 230 and 232 further connect cups 225 to shell 215. Straps 235 extend through openings 240 to the outwardly-facing portion of camisole 200. Likewise, shoulder straps 220 extend from the interior of camisole 200 through opening 243 to the outwardly-facing portion of camisole 200. Strap 235 is connected to shoulder strap 220 at location 253, and fastening component 245 is configured to removably attach along the length of shoulder straps 220 at one more attachment locations 250.

Figure 3:
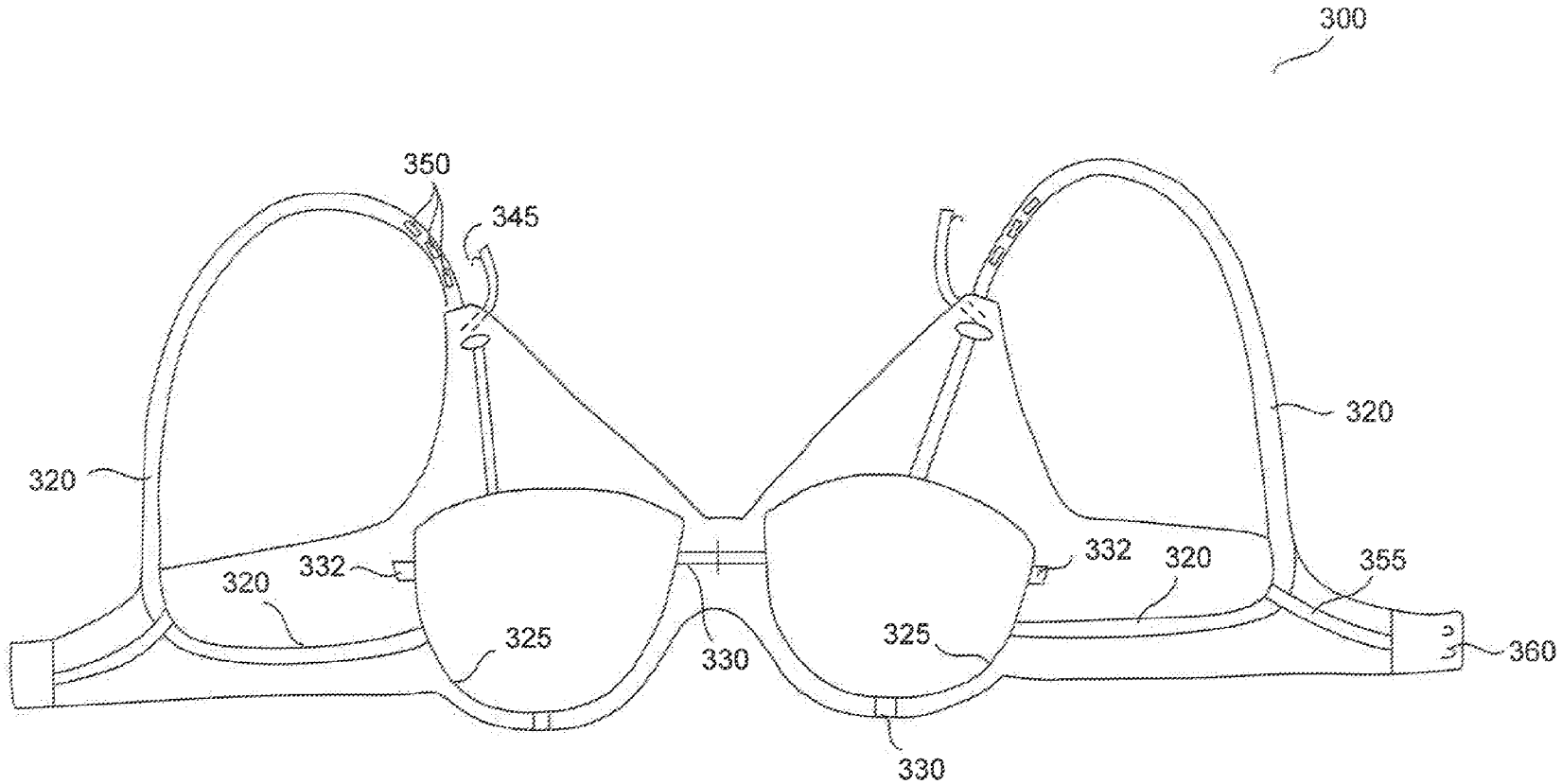
FIG. 3 illustrates a rear view of a brassiere having shoulder straps connected directly to the breast cups in accordance with an exemplary embodiment.

With reference now to FIG. 3, in an exemplary embodiment, a brassiere 300 is configured to allow horizontal movement of breast cups relative to the shell. Cups 325 are connected directly to shoulder straps 320 of brassiere 300. Shoulder straps 320 may be connected to cups 325 in any suitable manner. For example, shoulder straps 320 may extend through one or more guide loops 355 to connect to cups 325.

In an exemplary embodiment, shoulder straps 320 are attached directly to cups 325. Shoulder straps 320 are configured to slide through one or more guide loops 355. In this manner, shoulder straps 320 may be tightened without pulling on the body of brassiere 300, thus preventing the back of brassiere 300 from rising up. In this exemplary embodiment, when shoulder straps 320 are tightened, additional breast support is provided by brassiere 300.

Further, attachment of fastening components 345 to a higher attachment location 350 will increase tension in shoulder strap 320, causing fasteners 330 and/or 332 to stretch, and allowing cups 325 to move horizontally away from the center of brassiere 300. Conversely, attachment of fastening components 345 to a lower attachment location 350 will cause tension in shoulder strap 320 to decrease, causing fasteners 330 and/or 332 to relax, and allowing cups 325 to move horizontally toward the center of brassiere 300.

Figure 4:
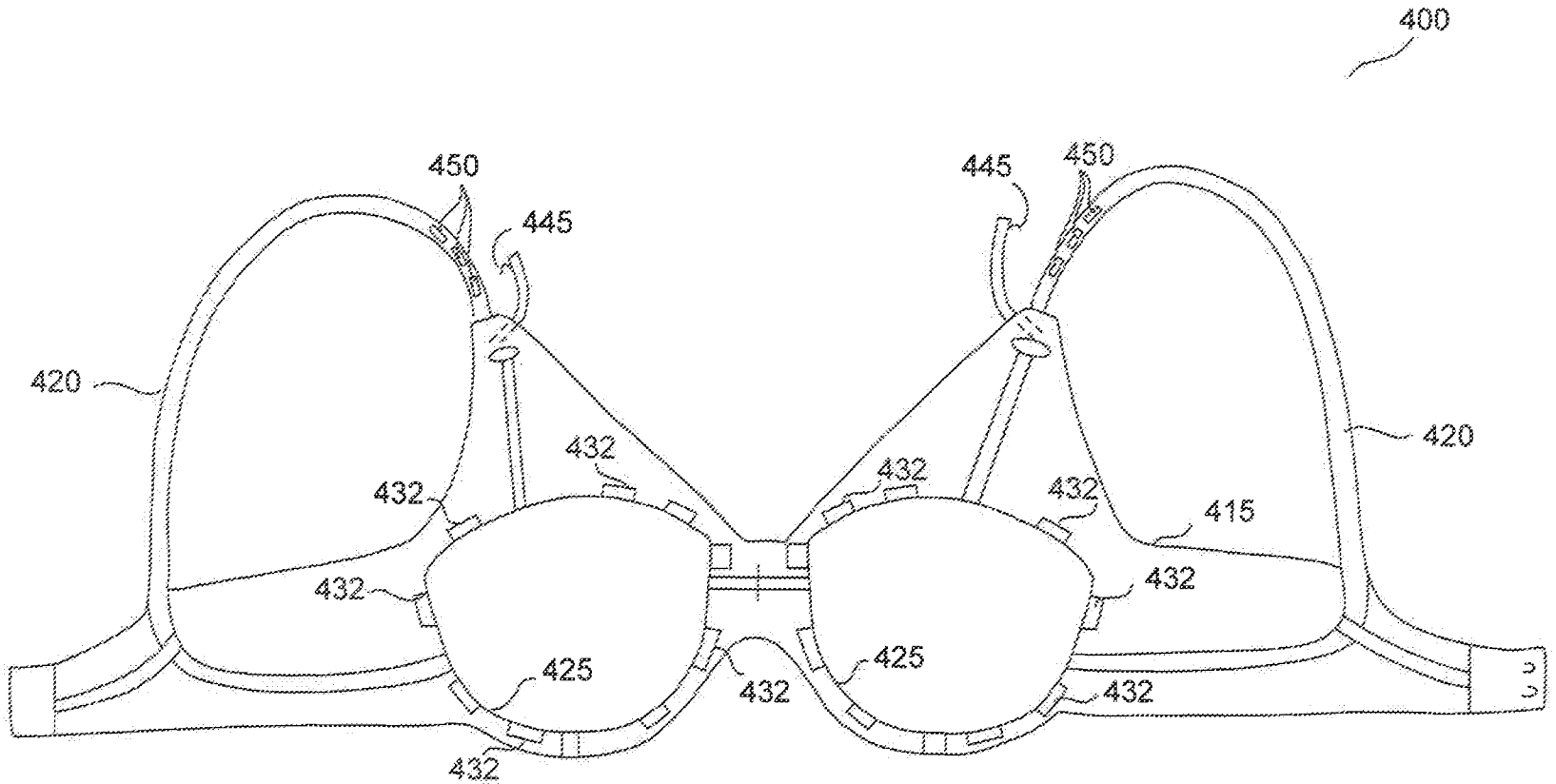
FIG. 4 illustrates a rear view of a brassiere having breast cups connected to a shell via a plurality of fasteners in accordance with an exemplary embodiment.

In various exemplary embodiments, breast cups may be configured with and/or coupled to any suitable type and/or number of elastic or inelastic fasteners. Turning now to FIG. 4, in an exemplary embodiment brassiere 400 comprises breast cups 425 connected to shell 415 via a plurality of fasteners 432. Adjusting the tension in shoulder straps 420, for example by placing fastening components 445 in various guide loops 450, causes the position of breast cups 425 to adjust.

Figure 5:
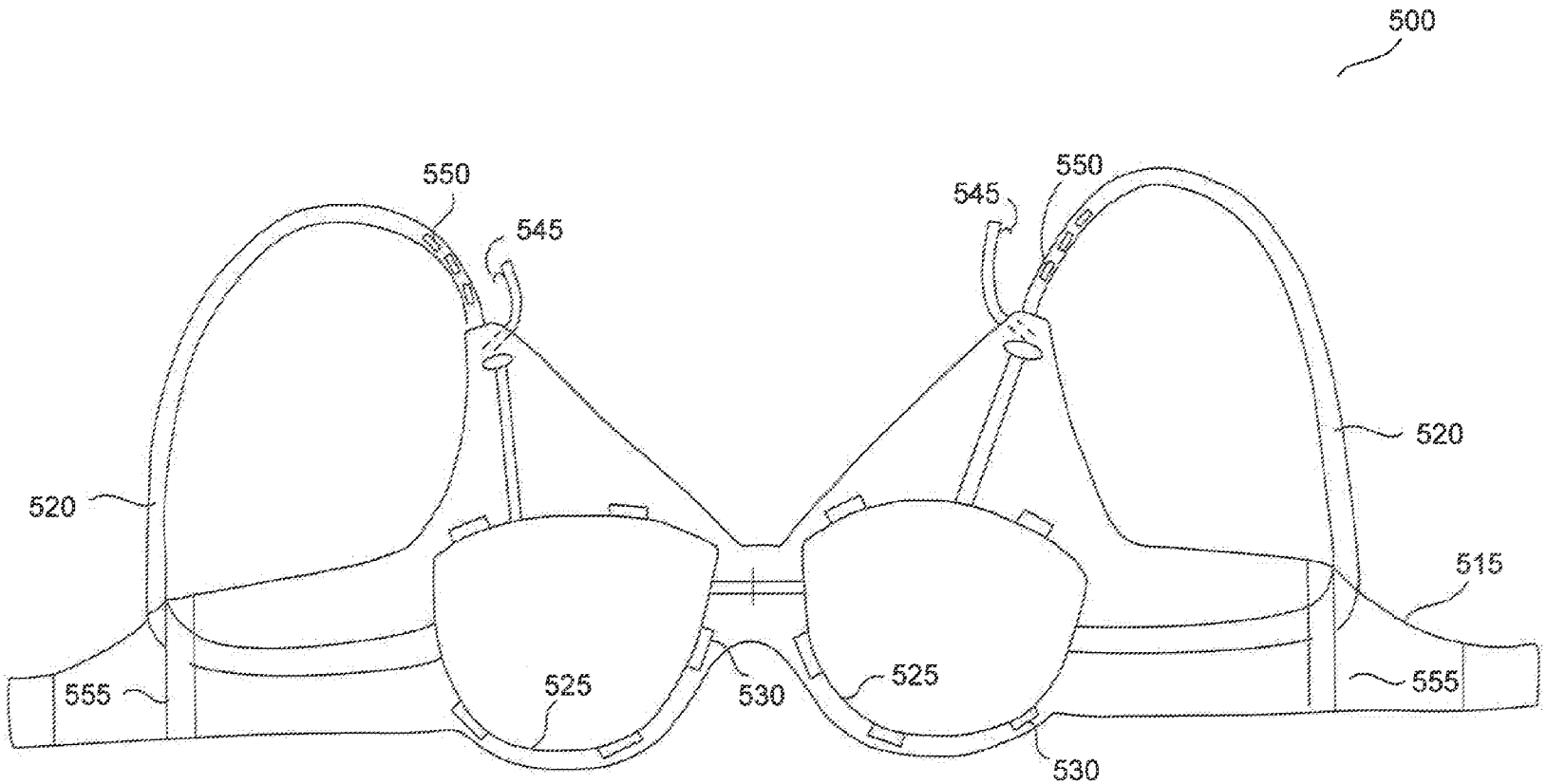
FIG. 5 illustrates a rear view of a brassiere comprising shoulder strap guide loops attached to the shell in accordance with an exemplary embodiment.

With reference now to FIG. 5, in an exemplary embodiment a brassiere 500 comprises guide loops 555 attached to shell 515. Shoulder straps 520 are routed through guide loops 555 and are attached to cups 525. In this manner, adjustment of fastening components 545 in various attachment locations 550 causes adjustment of cups 525. Cups 525 comprise and/or are coupled to elastic fasteners 530 to facilitate adjustment of cups 525. Moreover, any of the attachments discussed herein may be permanently or removably attached.

Figure 6:
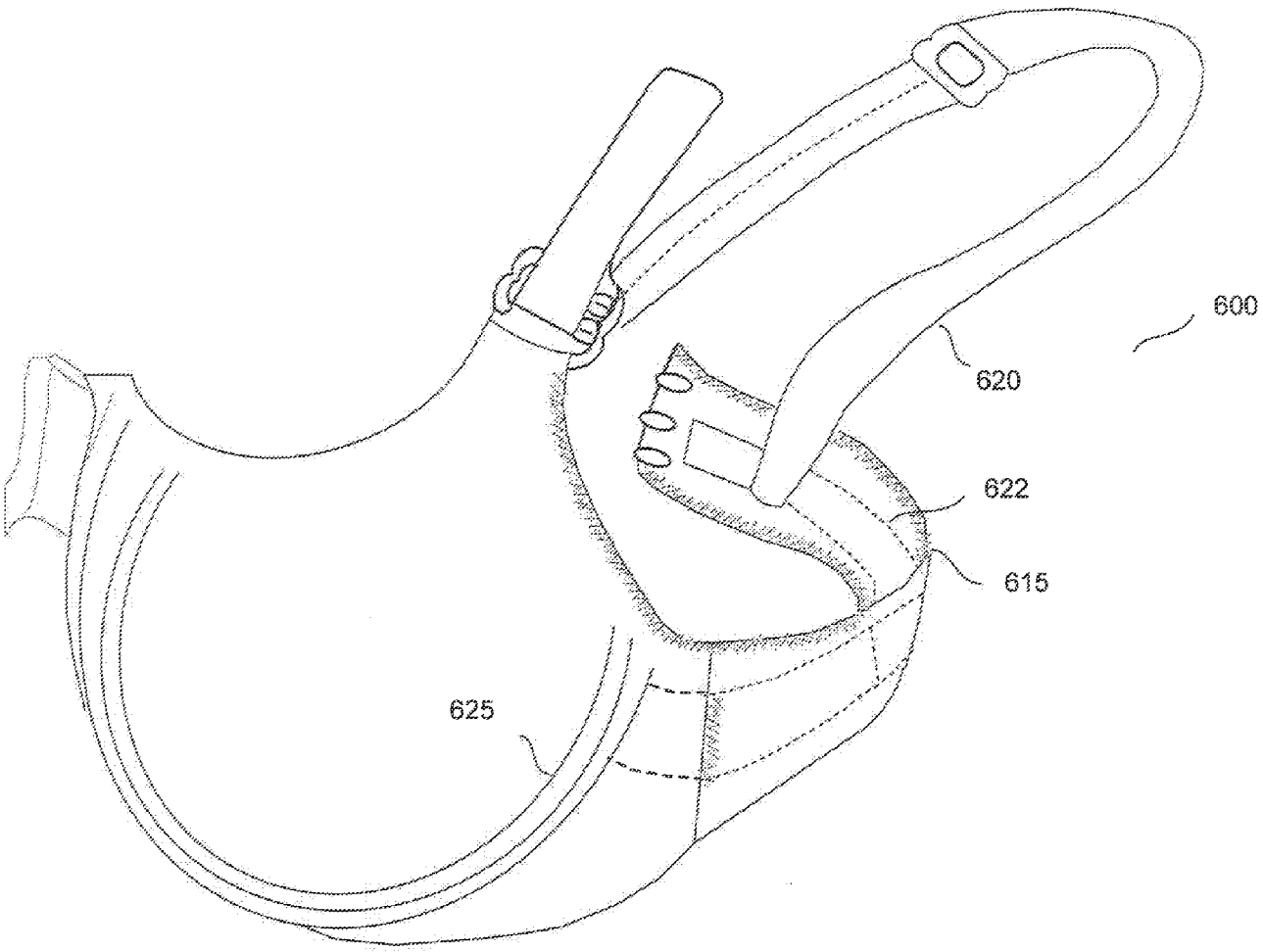
FIG. 6 illustrates a rear view of a brassiere comprising a back clasp in accordance with an exemplary embodiment.

Turning to FIG. 6, in an exemplary embodiment a brassiere 600 comprises shoulder strap 620 connected to attachment strap 622. Attachment strap 622 is coupled to shell 615 (for example, at least partially disposed within shell 615) so as to extend from the front of brassiere 600 to the back of brassiere 600. As illustrated in FIG. 6, attachment strap 622 is coupled directly to bra cup 625. However, attachment strap 625 may be coupled to any suitable location on brassiere 600, such as shell 615.

Figure 7:
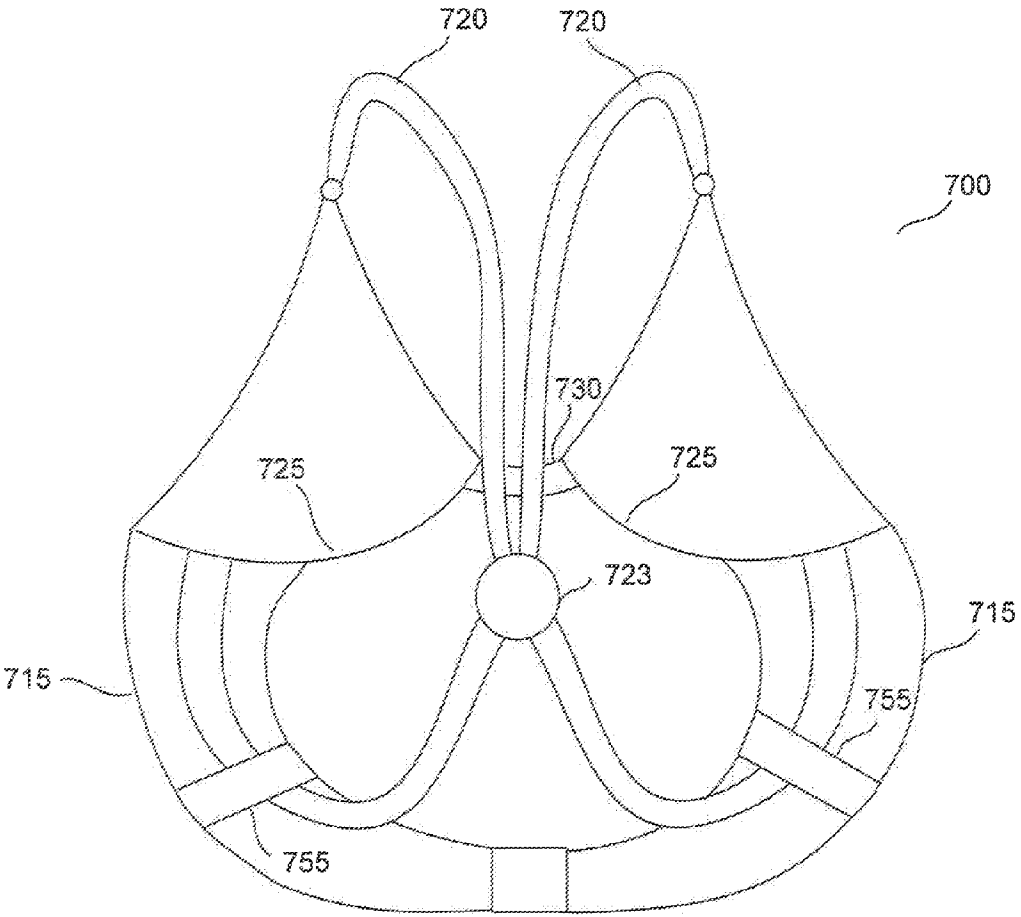
FIG. 7 illustrates a front view of a brassiere having an adjustable strap connected to a breast cup in accordance with an exemplary embodiment.
Figure 8:
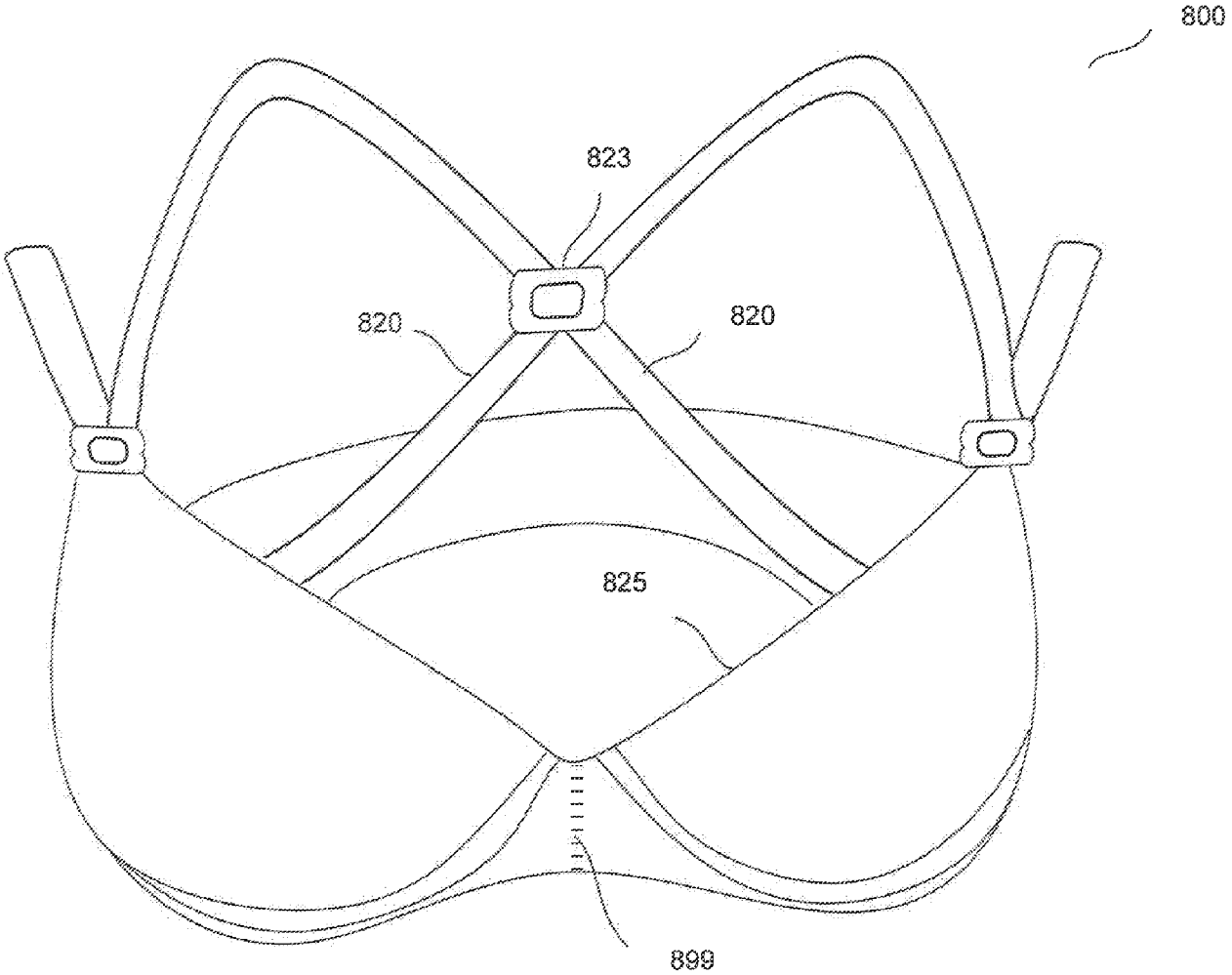
FIG. 8 illustrates a front view of a brassiere comprising a front closure device and a back clasp in accordance with an exemplary embodiment.

In various exemplary embodiments, with reference now to FIGS. 7-8, a brassiere 700/800 comprises shoulder straps 720/820 connected to back clasp 723/823. In an exemplary embodiment illustrated in FIG. 6, shoulder straps 620 are connected through attachment locations 655 on shell 615 to cups 625, and elastic fastener 630 connects cups 625. In an exemplary embodiment illustrated in FIG. 8, shoulder straps 820 are connected to cups 825, and front closure device 899 connects cups 825 to allow brassiere 800 to be opened from the front. It will be understood that, in various exemplary embodiments, shoulder straps 720/820 may be connected to the front body of brassiere 700/800 containing bra cups 725/825.

Moreover, in various exemplary embodiments, the location of each breast cup may be adjusted independently of the other breast cup, so as to improve customizability of the appearance of the bust, user comfort, and/or the like. Moreover, a breast support garment configured in accordance with principles of the present disclosure may be configured such that the breast cup is moveable horizontally, vertically, or both horizontally and vertically relative to the shell or other portions of the breast support garment.

In various exemplary embodiments, a breast support garment does not comprise a separate breast cup. Rather, one or more bra straps or other supporting structures are attached directly to the front of the breast support garment, thus removing the need to alter (or add) a cup. In these exemplary embodiments, the front of the breast support garment may extend beneath the axilla to the lateral side of the back, enabling a wearer to tighten a strap and give support to the chest (while eliminating the need for a strap across the back portion of the breast support garment).

In various exemplary embodiments, a breast support garment may be fastened around a wearer with one or more connectors, for example connectors located on a band. With momentary reference to FIG. 3, in various exemplary embodiments connectors 360 may be located on a band in the back of the breast support garment, in the front of the breast support garment between the cups, and/or in any other suitable location. In other exemplary embodiments, a breast support garment is configured to be pulled over the head of the user without the use of connectors.

Figure 9:
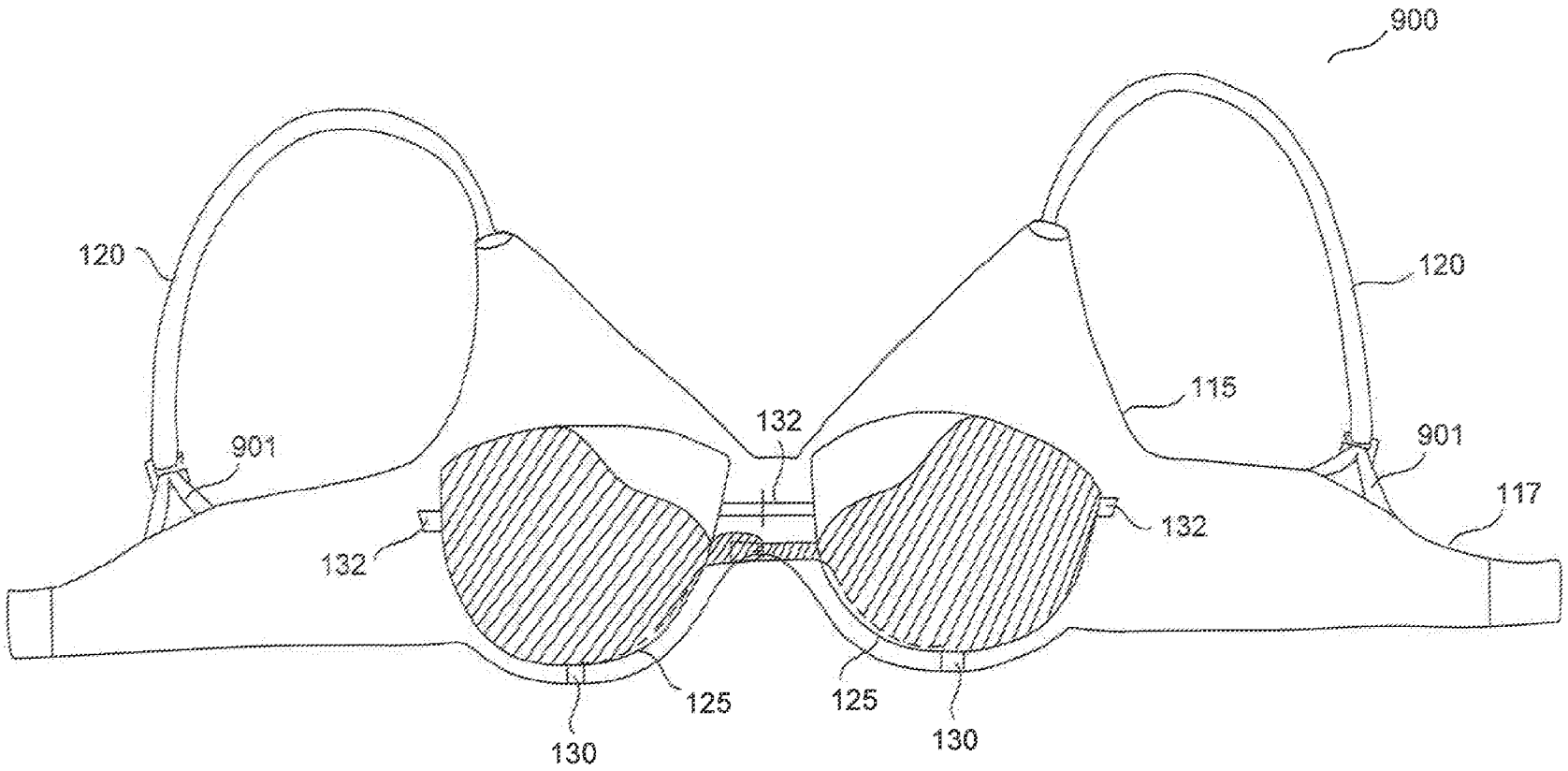
FIG. 9 illustrates a front view of a brassiere having an adjustable front coupling portion and an adjustable shoulder strap coupling location in accordance with an exemplary embodiment.

In various exemplary embodiments, shoulder straps may be coupled to a band in an adjustable manner. For example, with reference now to FIG. 9, shoulder straps 120 on brassiere 900 are coupled to band 117 via flexible couplers 901. Flexible couplers 901 may comprise a suitable flexible and/or elastic material, for example elastane or similar. As illustrated in FIG. 9, flexible couplers 901 comprise a portion of fabric coupled to band 117 at two distinct locations and passed therebetween through a coupler disposed at the end of shoulder straps 120, in order to create a flexible and generally triangular arrangement. Thus, horizontal and/or vertical movement and/or adjustment of shoulder straps 120 may be achieved without the need to relocate and/or adjust band 117 or other portions of shell 115, and vice versa. Moreover, flexible couplers 901 may comprise any suitable material and/or be located at any suitable location on brassiere 900.

Figure 10A:
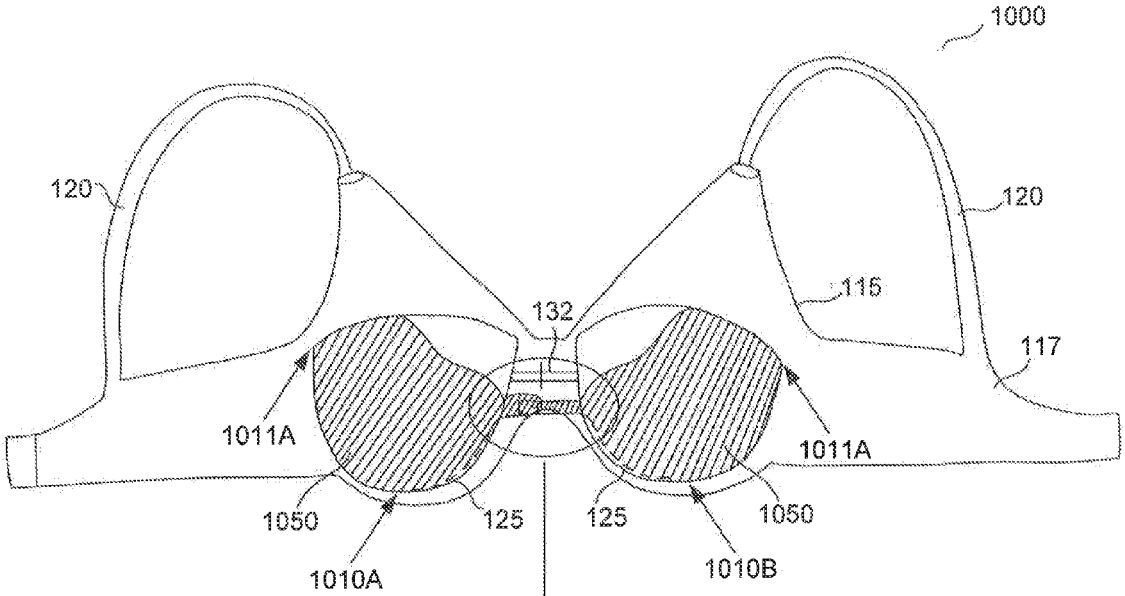
FIGS. 10A and 10B illustrate a brassiere having an adjustable front coupling portion in accordance with an exemplary embodiment.
Figure 10B:
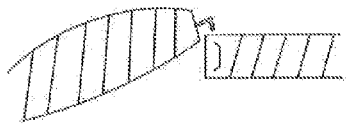

In various exemplary embodiments, turning now to FIGS. 10A and 10B, a brassiere 1000 comprises cups 125 which may be further adjusted via use of outer cup coverings 1050. Outer cup coverings 1050 may comprise any appropriate fabric, material, or other structure configured to couple with cups 125 and/or other portions of brassiere 1000. As illustrated, outer cup coverings 1050 are located at least partially over cups 125. In an exemplary embodiment, outer cup coverings 1050 comprise fabric coupled to cups 125 via stitching along the outer and lower portions of cups 125 (e.g., outer cup coverings 1050 are stitched to the left and right cups 125 between locations 1010A and 1011A, and 1010B and 1011B, respectively). Locations 1010A and 1010E are preferably located at the bottom center of each of cups 125.

Portions of outer cup coverings 1050 may be configured to couple to one another. For example, with reference to FIG. 10B, one outer cup covering 1050 may be configured with a hook, and a corresponding outer cup covering 1050 may be configured with a loop. Moreover, the coupling may be flexible, adjustable and/or releasable, as desired. Outer cup coverings 1050 may be coupled together in order to apply a force to cups 125, for example to urge cups 125 closer to one another.

Outer cup coverings 1050 may be coupled together in any suitable manner. Because outer cup coverings 1050 are not coupled to cups 125 along the inner edges of cups 125, but are instead coupled to cups 125 along the outer portion and/or the outer bottom portion of cups 125, the outer edges of cups 125 are urged together more forcefully than the inner edges of cups 125. Consequently, the wearer achieves a fuller and/or more "pushed-up" appearance of the bust, as desired, while reducing associated discomfort, fitting issues, and/or other effects on other portions of the bra. In this manner, certain disadvantages of conventional "push-up" style bras may thus be eliminated.

In various exemplary embodiments, a breast support garment may be configured with multiple breast cups, for example an inner breast cup and an outer breast cup. Each of the breast cups may be configured to be independently adjustable.

For example, in an exemplary embodiment an inner breast cup is disposed behind an outer breast cup. The inner breast cup may, be coupled to the outer breast cup at one or more locations, for example via a flexible coupling. However, the inner breast cup may also be coupled to the main body of the breast support garment, and thus may not be coupled to the outer breast cup at all. The inner breast cup and the outer breast cup may each be adjustably coupled to a common shoulder strap, for example via flexible straps coupled to the respective breast cups and to the common shoulder strap. The inner breast cup and the outer breast cup may also be adjustably coupled to other locations on the breast support garment. In this manner, the coupling of the inner breast cup to the shoulder strap (or other portions of the breast support garment) may be adjusted independently of the coupling of the outer breast cup to the shoulder strap (or other portions of the breast support garment). Stated another way, the tension on the inner breast cup may differ from and/or be adjusted independently of the tension on the outer breast cup. In this manner, a desired appearance of the bust may be more easily achieved, while mitigating wearer discomfort.

Figure 11A:
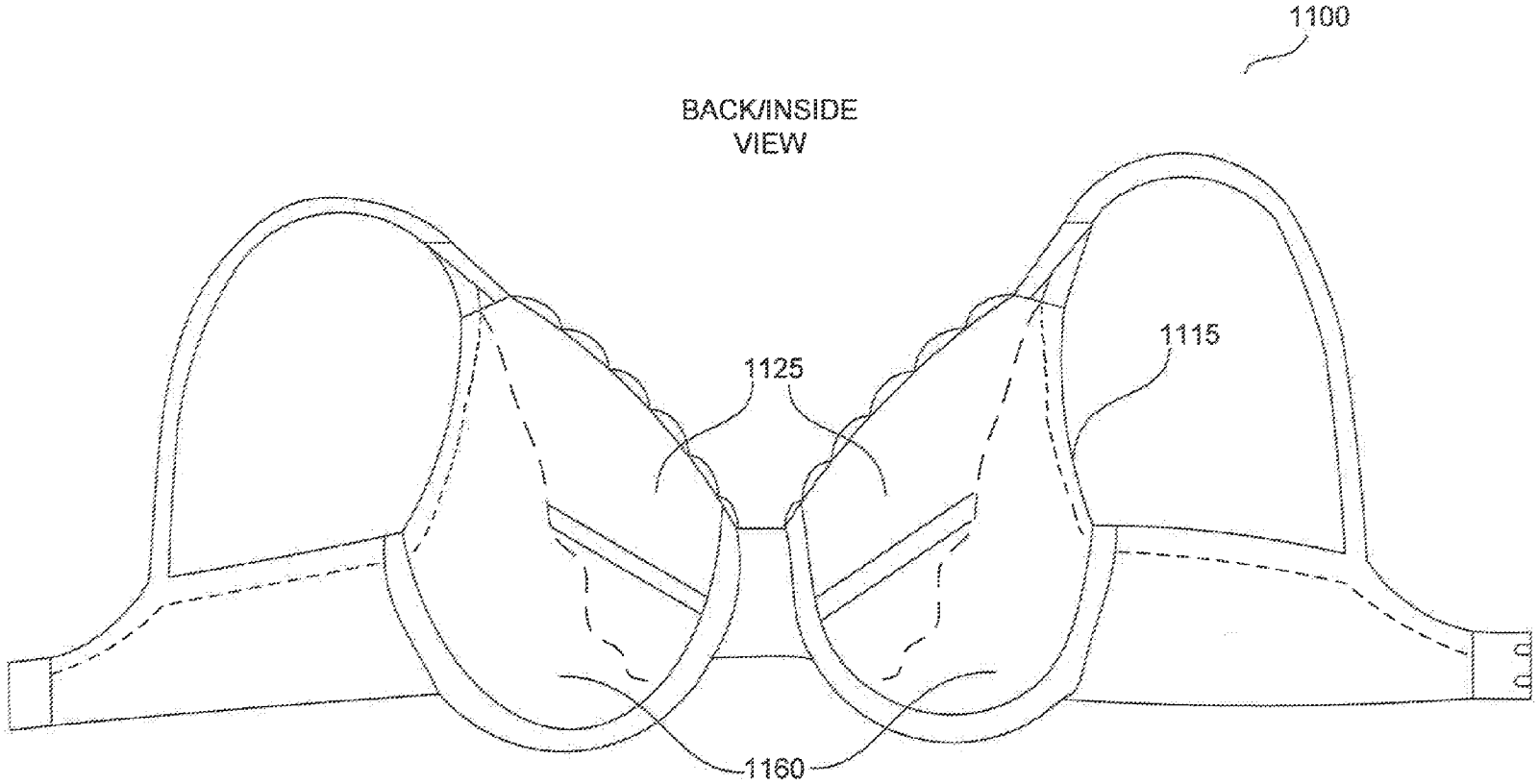
FIGS. 11A and 11B illustrate a brassiere having a shelf portion in accordance with an exemplary embodiment.
Figure 11B:
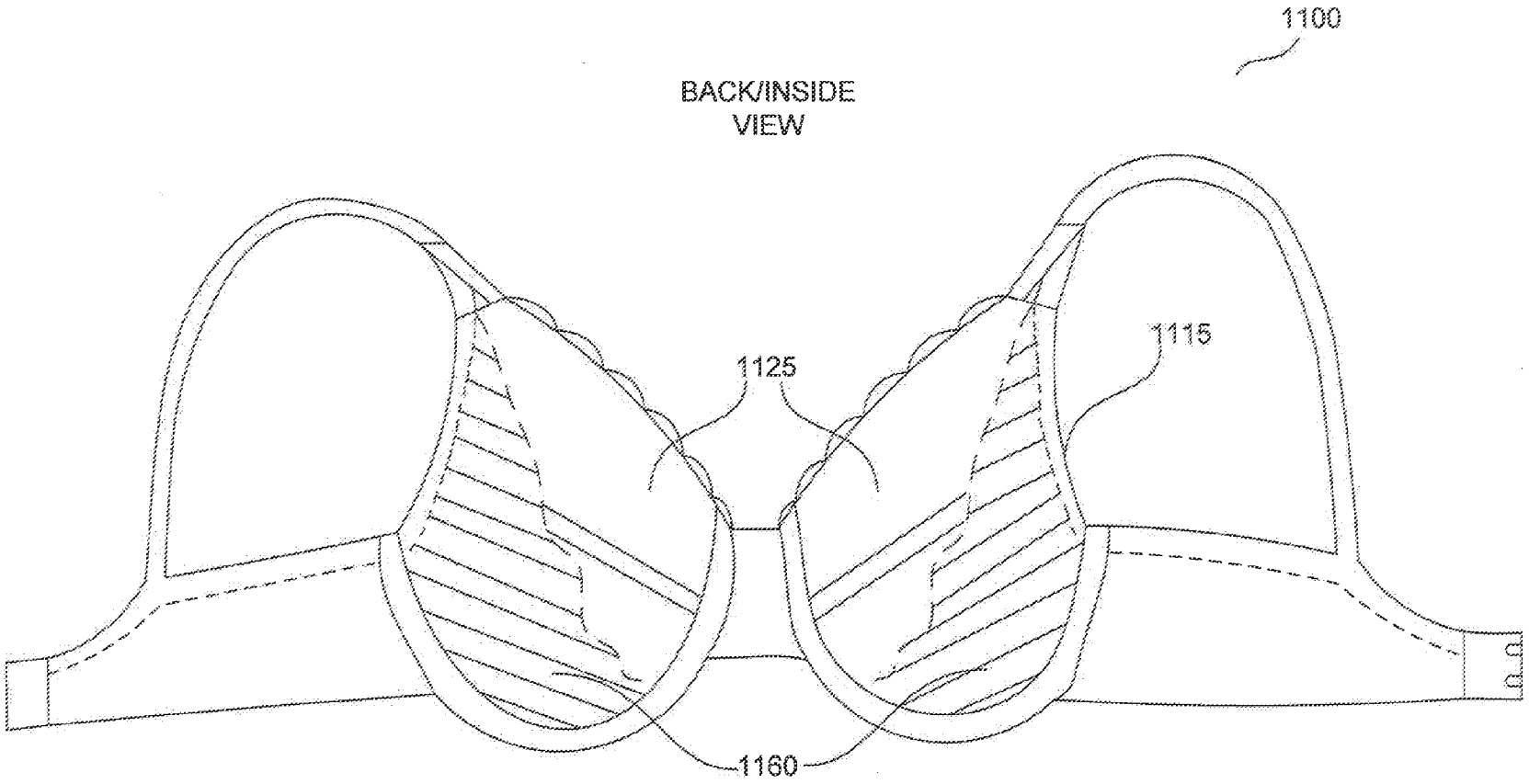

Turning now to FIGS. 11A and 11B, in various exemplary embodiments a breast support garment, for example brassiere 1100, may be configured with one or more "shelf" portions, for example shelf portions 1160. Shelf portions 1160 may be sized and shaped in order to alter one or more properties of a breast support garment. Additionally, shelf portions 1160 may be coupled to a breast support garment in a manner configured to alter one or more properties of a breast support garment.

In an exemplary embodiment, shelf portions 1160 comprise a flexible material configured to alter one or more properties of a breast support garment. In various exemplary embodiments, shelf portions 1160 comprise one or more of cotton, nylon, rayon, elastane, and/or combinations of the same. Shelf portions 1160 may be sheer. Moreover, shelf portions 1160 may comprise a mesh, a knit, a lace, a tricot, and/or another other suitable fabric style and/or material. Shelf portions 1160 may be monolithic. In an exemplary embodiment, shelf portions 1160 may comprise one or more strips or patches of flexible material. Shelf portions 1160 may couple and/or otherwise link shell 1125 and breast cups 1125; alternatively, shell 1125 and breast cups 1125 may be directly coupled to one another.

With continued reference to FIGS. 11A and 11B, in an exemplary embodiment, a shelf portion 1160 is disposed on the interior of each of left and right breast cups 1125. In other exemplary embodiments, shelf portions 1160 are disposed on the exterior of left and right breast cups 1125. Shelf portions 1160 are configured to alter one or more properties of a breast support garment. For example, in one embodiment wherein shelf portions 1160 are disposed generally on the outside portion (i.e., generally on the side of the breast cups away from the midline) of respective breast cups 1125 (for example, as illustrated in FIGS. 11A and 11B), shelf portions 1160 may act to press the breasts of a wearer closer to one another, enhancing cleavage. Moreover, in various exemplary embodiments, shelf portions 1160 are configured to flex to allow respective breast cups 1125 to move at least partially upward and/or downward, while providing a reduced degree of flex and/or give at the lateral sides of breast cups 1125 (e.g., near the anus of a wearer).

Figure 12A:
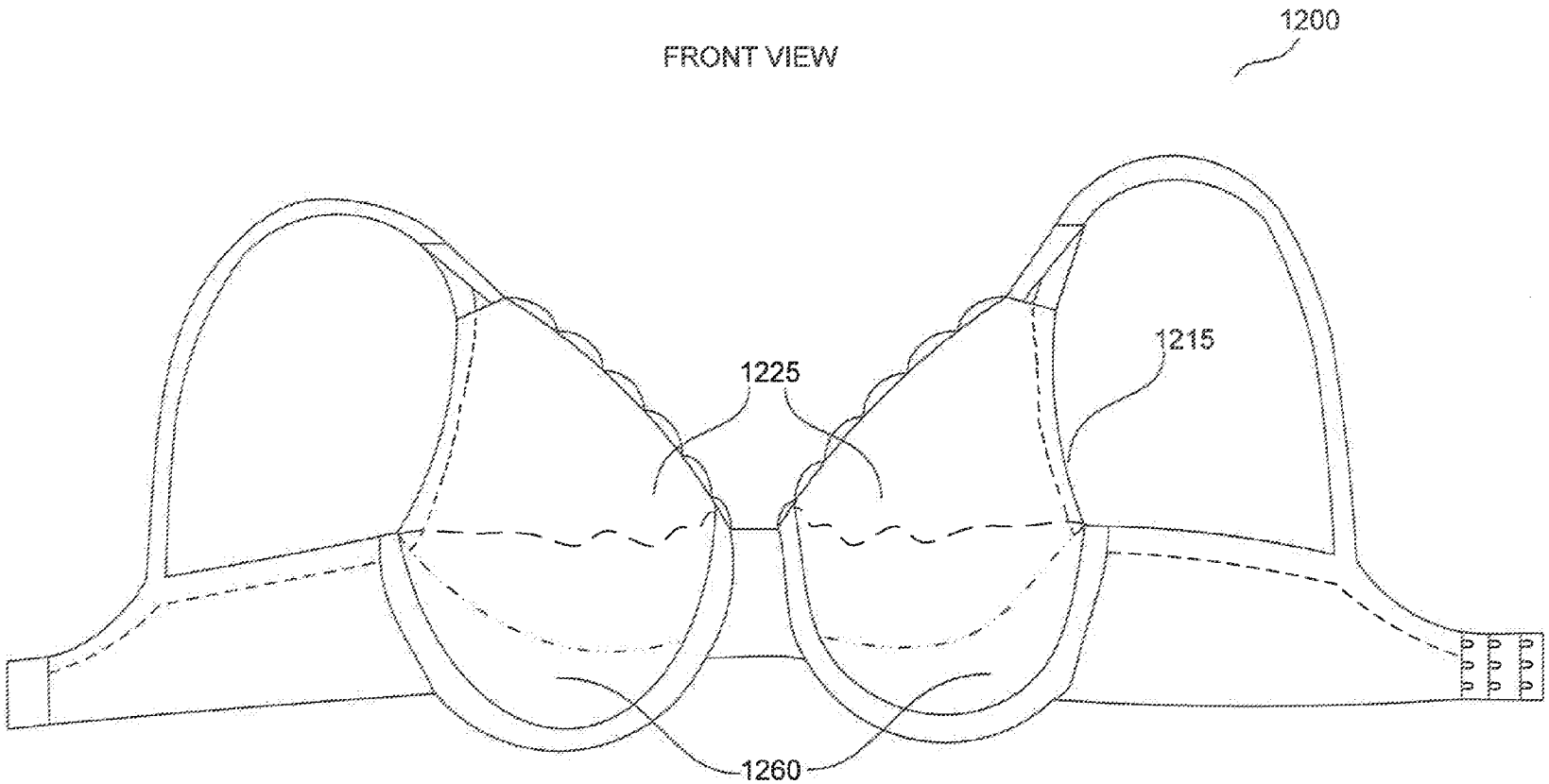
FIGS. 12A and 12B illustrate a brassiere having a shelf portion in accordance with an exemplary embodiment.

In another exemplary embodiment, with momentary reference to FIG. 12A, shelf portions 1260 may be disposed generally on a lower portion of respective breast cups 1225. In this manner, shelf portions 1260 may act to provide additional breast lift and/or support, achieving a fuller and/or more "pushed up" appearance. Shelf portions 1260 may be coupled to the respective breast cups 1225 along all edges of shelf portions 1260, for example via stitching. In this manner, "rolling" and/or folding of the material comprising shelf portions 1260 may be reduced and/or eliminated. Alternatively, shelf portions 1260 may be coupled to the respective breast cups 1225 only at certain locations, for example via stitching, straps, and/or the like.

Shelf portions 1260 may be configured to remain below the nipple of a wearer; alternatively, shelf portions 1260 may be configured to extend above the nipple of a wearer. Moreover, shelf portions 1260 may be constructed of material having a first amount of elasticity in a first direction, and a second amount of elasticity in a second direction. The material comprising shelf portions 1260 may thus be aligned to provide a first degree of support in a particular direction (for example, a vertical direction) and a second, differing degree of support in another direction (for example, a lateral direction). In this manner, shelf portions 1260 may provide variable and/or adjustable support to a breast.

Returning now to FIGS. 11A and 11B, in various exemplary embodiments multiple shelf portions 1160 may be coupled to a breast cup 1125. For example, a first shelf portion 1160 may be disposed on the interior of a particular breast cup 1125, and a second shelf portion 1160 may be disposed on the exterior of a particular breast cup 1125. First shelf portion 1160 and second shelf portion 1160 may be configured with a generally similar shape and/or be coupled to a breast cap 1125 in a similar manner; alternatively, first shelf portion 1160 and second shelf portion 1160 may be configured with different shapes and/or be coupled to a breast cup 1125 in a similar manner. Yet further, first shelf portion 1160 and second shelf portion 1160 may comprise differing materials. In an exemplary embodiment, first shelf portion 1160 is disposed generally on the lower interior portion of a breast cup 1125 in order to provide additional breast lift. Second shelf portion 1160 is disposed generally on the outside exterior portion of a breast cup 1125 in order to urge the breasts of a wearer closer to one another, increasing cleavage.

Figure 12B:
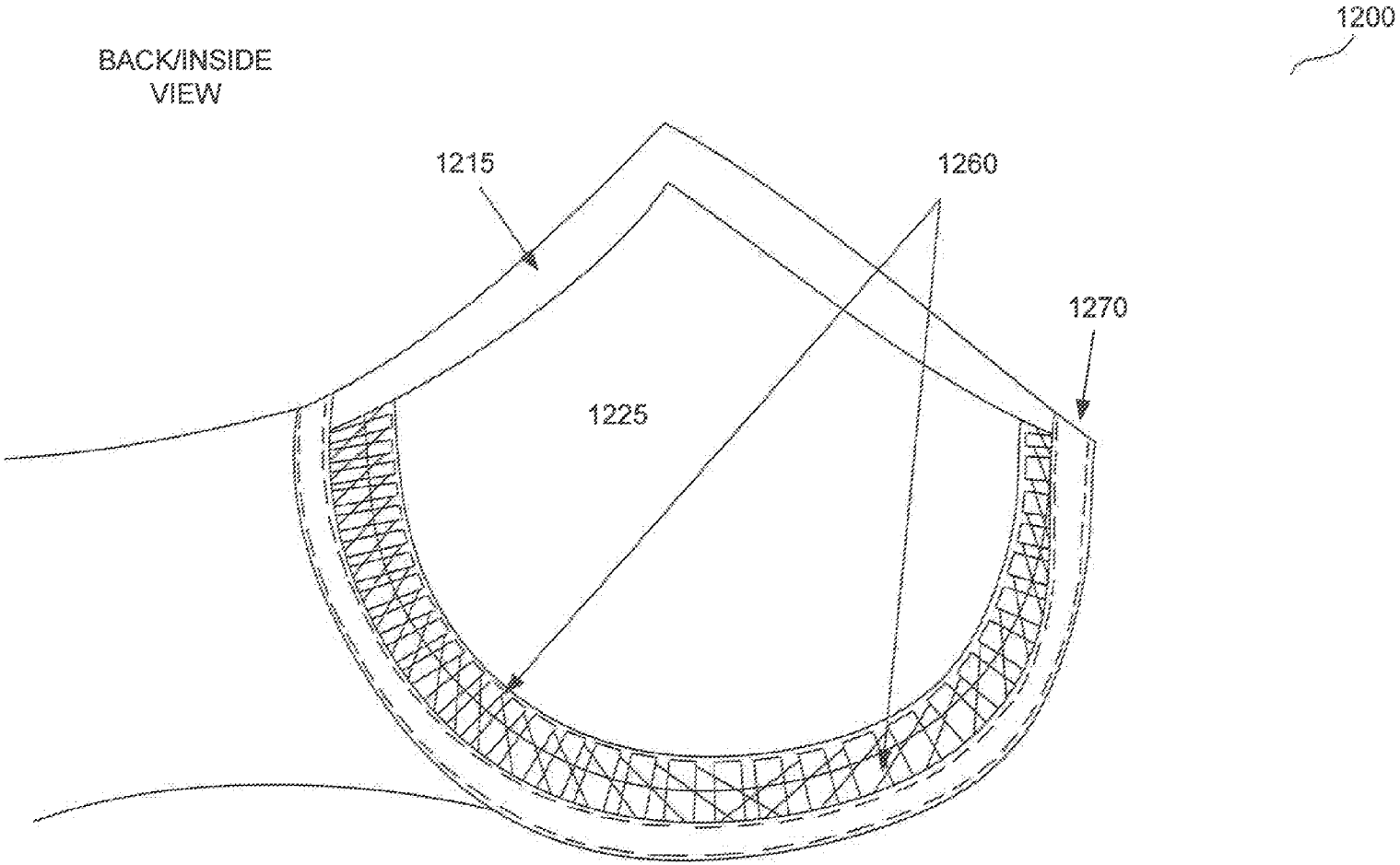

With reference now to FIG. 12B, one or more shelf portions 1260 may be configured to "track" and/or extend along a coupling between breast cup 1225 and shell 1215. For example, a shelf portion 1260 may extend generally along the portion of breast cup 1225 coupled to shell 1215. Moreover, a shelf portion 1260 may extend generally along an underwire 1270. A shelf portion 1260 disposed on the interior of breast cup 1225 may extend over a corresponding area as a shelf portion 1260 disposed on the exterior of breast cup 1225; alternatively, an interior shelf portion 1225 may extend over a different area than an exterior shelf portion 1225.

Figure 13:
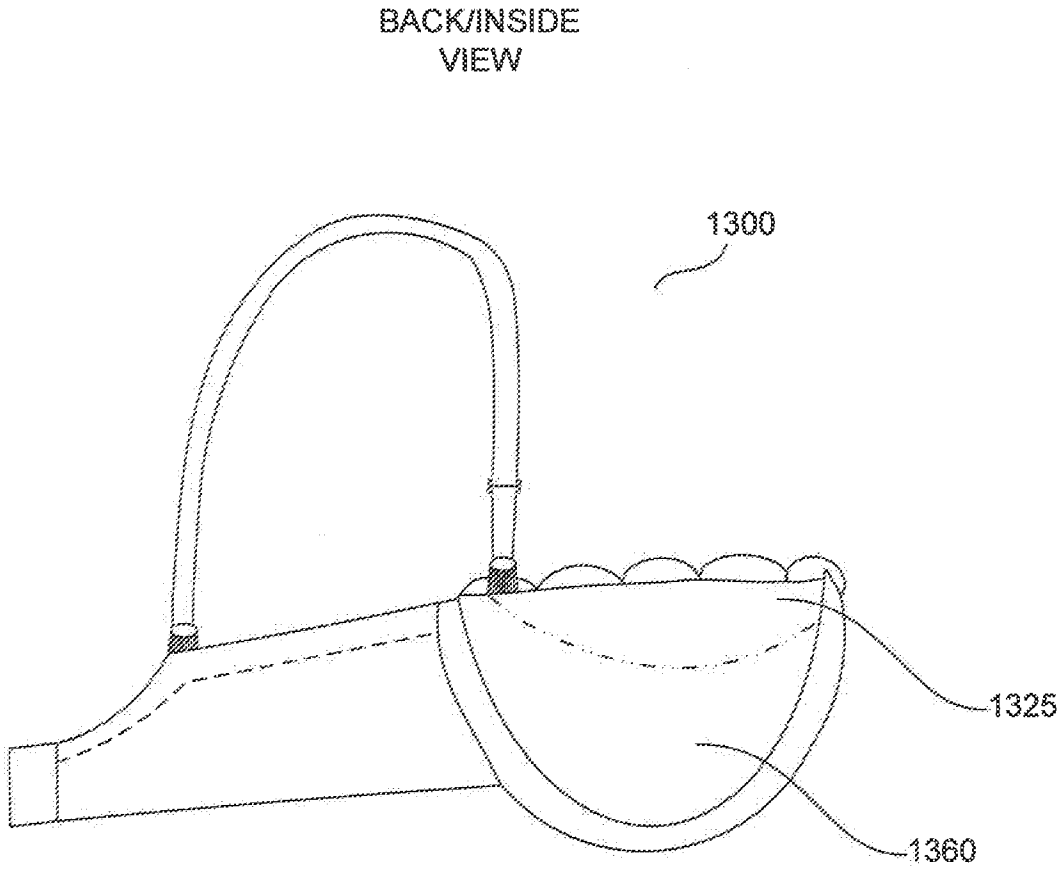
FIG. 13 illustrates a portion of a brassiere having a shelf portion disposed on the inner side of a breast cup in accordance with an exemplary embodiment.
Figure 14:
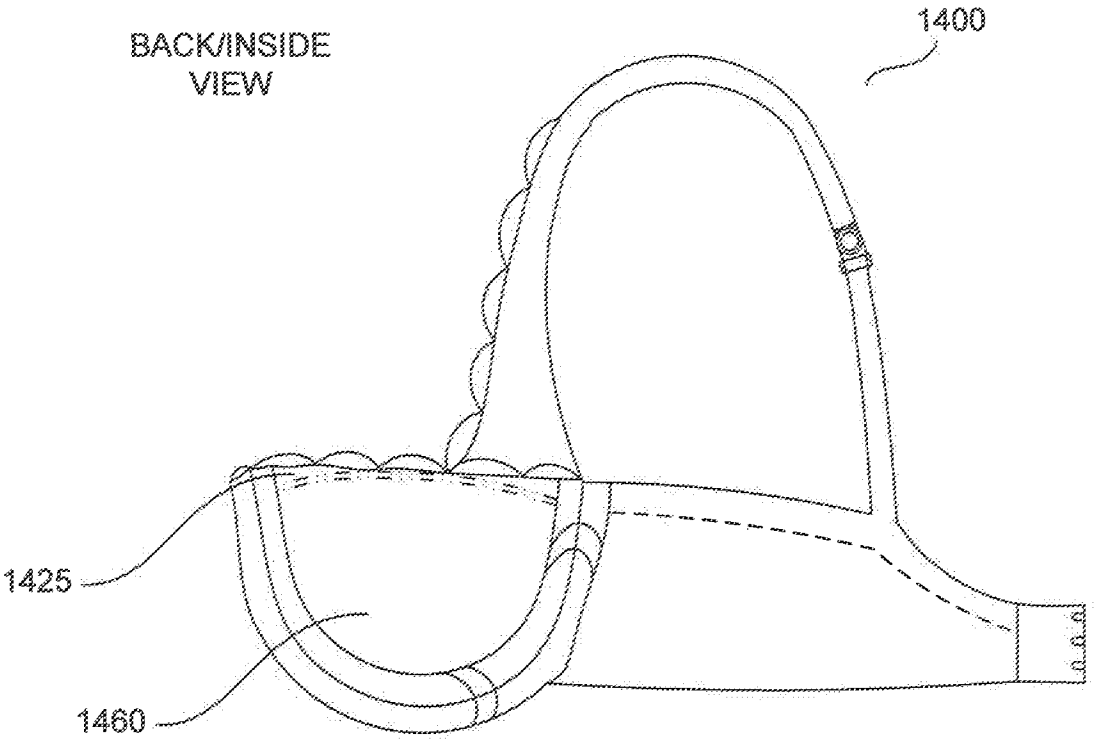
FIG. 14 illustrates a portion of a brassiere having a shelf portion disposed on the outer side of a breast cup in accordance with an exemplary embodiment.

Turning now to FIGS. 13 and 14, in various exemplary embodiments, a breast support garment, for example brassiere 1300 or 1400, may be configured with a shelf portion 1360 or 1460, respectively. Shelf portions 1360 or 1460 may be disposed on the interior and/or exterior of breast cups 1325 or 1425, respectively. In various exemplary embodiments, shelf portions 1360 or 1460 may provide supplemental support responsive to movement and/or lift of breast cups 1325 or 1425, respectively. Moreover, shelf portions 1360 or 1460 may act to prevent breast cups 1325 or 1425 from extending beyond a desired distance away from the body of a wearer.

While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure and may be expressed in the following claims.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, a functional connection, and/or any other connection. When language similar to "at least one of A, B, or C" or "at least one of A, B, and C" is used in the claims or specification, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A breast support garment, comprising:

a breast cup;

an adjustable shoulder strap coupled to the breast cup, wherein the shoulder strap is configured to impart a tension force to the breast cup; and a shelf portion coupled to the breast cup, wherein the shelf portion comprises elastane, and wherein the shelf portion is configured to push up a breast of a wearer of the breast support garment.

2. The breast support garment of claim 1, further comprising an outer shell, wherein the breast cup is coupled to the outer shell via an elastic fastener.

3. The breast support garment of claim 1, wherein the shelf portion comprises a flexible material disposed along a lower portion of the breast cup.

4. The breast support garment of claim 1, wherein the breast support garment comprises a first shelf portion coupled to an interior side of the breast cup, and a second shelf portion coupled an exterior side of the breast cup.

5. The breast support garment of claim 4, wherein the first shelf portion and the second shelf portion differ in size.

6. The breast support garment of claim 1, wherein the shelf portion comprises a material providing a first degree of support in a first direction and a second, differing degree of support in a second direction.

7. The breast support garment of claim 6, wherein the first direction is vertical and the second direction is horizontal.

8. The breast support garment of claim 1, wherein the shoulder strap is configured such that when the shoulder strap is shortened, the breast cup moves upward, and when the shoulder strap is lengthened, the breast cup moves downward.

9. The breast support garment of claim 1, wherein the shoulder strap is configured such that when the shoulder strap is shortened, the breast cup moves horizontally in a first direction, and when the shoulder strap is lengthened, the breast cup moves horizontally in a second direction opposite the first direction.

* * * * *